US007959772B2

(12) United States Patent
De Nora

(10) Patent No.: US 7,959,772 B2
(45) **Date of Patent: *Jun. 14, 2011**

(54) ALUMINIUM ELECTROWINNING CELLS WITH SLOPING FORAMINATE OXYGEN-EVOLVING ANODES

(75) Inventor: Vittorio De Nora, Nassau (BS)

(73) Assignee: Riotinto Alcan International Limited, Montreal (CA)

( * ) Notice: Subject to any disclaimer, the term of this patent is extended or adjusted under 35 U.S.C. 154(b) by 1039 days.

This patent is subject to a terminal disclaimer.

(21) Appl. No.: 10/488,172

(22) PCT Filed: Aug. 29, 2002

(86) PCT No.: PCT/IB02/03518

§ 371 (c)(1),
(2), (4) Date: Mar. 1, 2004

(87) PCT Pub. No.: WO03/023092

PCT Pub. Date: Mar. 20, 2003

(65) Prior Publication Data

US 2004/0216997 A1 Nov. 4, 2004

(30) Foreign Application Priority Data

Sep. 7, 2001 (WO) ..... PCT/IB01/01632

(51) Int. Cl.
*C25C 3/06* (2006.01)
*C25C 3/08* (2006.01)
*C25C 3/12* (2006.01)

(52) U.S. Cl. ..... 204/245; 204/243.1; 204/237; 205/372; 205/376; 205/381; 205/392

(58) Field of Classification Search ..... None
See application file for complete search history.

(56) References Cited

U.S. PATENT DOCUMENTS

| | | | | |
|---|---|---|---|---|
| 4,504,366 | A * | 3/1985 | Jarrett et al. | 205/372 |
| 5,362,366 | A * | 11/1994 | de Nora et al. | 205/375 |
| 5,368,702 | A * | 11/1994 | de Nora | 205/373 |
| 6,287,447 | B1 * | 9/2001 | de Nora et al. | 205/378 |
| 6,540,887 | B2 * | 4/2003 | de Nora | 204/243.1 |
| 6,607,657 | B2 * | 8/2003 | de Nora et al. | 205/381 |
| 6,638,412 | B2 * | 10/2003 | De Nora et al. | 205/385 |
| 6,800,191 | B2 * | 10/2004 | Barnett et al. | 205/380 |
| 2002/0027069 | A1 * | 3/2002 | de Nora | 204/243.1 |

* cited by examiner

*Primary Examiner* — Harry D Wilkins, III
(74) *Attorney, Agent, or Firm* — Jayadeep R Deshmukh

(57) ABSTRACT

A cell for the electrowinning of aluminum (50) from alumina, comprises an inclined plate-like or grid-like open anode structure (25) which has a generally v-shaped configuration in cross-section. The anode structure (25) has a downwardly-oriented sloping electrochemically active surface that is generally v-shaped in cross-section and spaced above an upwardly-oriented corresponding sloping cathode surface (11) by an anode-cathode gap (40) in which alumina dissolved in a circulating electrolyte (60) is electrolysed. The anode structure (25) has a plurality of anode through-passages (45) distributed thereover for an up-flow of alumina-depleted electrolyte (60) from the anode-cathode gap (40). One or more electrolyte guide members (30,30',30") located above the open anode structure (25) is/are arranged to guide substantially all the up-flowing alumina-depleted electrolyte (60) to an alumina feeding area (63), where it is enriched with alumina and then over and around an upper end (27) of the generally v-shaped plate-like or grid-like anode structure (25) into the anode-cathode gap (40). Alumina-enriched electrolyte (60) can be fed into a lower end and/or into an upper end of the anode-cathode gap (40).

26 Claims, 4 Drawing Sheets

ALUMINIUM ELECTROWINNING CELLS WITH SLOPING FORAMINATE OXYGEN-EVOLVING ANODES

FIELD OF THE INVENTION

This invention relates to a cell for the electrowinning of aluminium from alumina dissolved in molten electrolyte, provided with a sloping foraminate anode and an aluminium-wettable drained sloping cathode.

BACKGROUND ART

The technology for the production of aluminium by the electrolysis of alumina, dissolved in molten cryolite containing salts, at temperatures around 950° C. is more than one hundred years old. This process and the cell design have not undergone any great change or improvement and carbonaceous materials are still used as electrodes and cell linings.

Using metal anodes in aluminium electrowinning cells would drastically improve the aluminium process by reducing pollution and the cost of aluminium production. Many patents have been filed on non-carbon anodes but none has found commercial acceptance, also because of economical reasons.

Several designs for oxygen-evolving anodes for aluminium electrowinning cells were proposed in the following documents. U.S. Pat. No. 4,681,671 (Duruz) discloses vertical anode plates or blades operated in low temperature aluminium electrowinning cells. U.S. Pat. No. 5,310,476 (Sekhar/de Nora) discloses oxygen-evolving anodes consisting of roof-like assembled pairs of anode plates. U.S. Pat. No. 5,362,366 (de Nora/Sekhar) describes non-consumable anode shapes, such as roof-like assembled pairs of anode plates. U.S. Pat. No. 5,368,702 (de Nora) discloses vertical tubular or conical oxygen-evolving anodes for multimonopolar aluminium cells. U.S. Pat. No. 5,683,559 (de Nora) describes an aluminium electrowinning cell with oxygen-evolving bent anode plates which are aligned in a roof-like configuration facing correspondingly shaped cathodes. U.S. Pat. No. 5,725,744 (de Nora/Duruz) discloses vertical oxygen-evolving anode plates, preferably porous or reticulated, in a multimonopolar cell arrangement for aluminium electrowinning cells operating at reduced temperature.

U.S. Pat. No. 5,938,914 (Dawless/LaCamera/Troup/Ray/Hosler) describes an aluminium electrowinning cell having vertical inert anodes interleaved with vertical cathodes. The anodes are covered with an angled roof which diverts anodically evolved oxygen bubbles to agitate the cell's molten electrolyte.

WO01/31088 (de Nora) discloses aluminium electrowinning cells with solid anodes having a V-shaped active surface facing sloping cathodes. The anodes and cathodes are associated with vertical passages for the circulation of alumina-rich electrolyte to a bottom part of the inter-electrode gaps spacing the anodes and cathodes.

WO00/40781 and WO00/40782 (both de Nora) both disclose aluminium production anodes with a series of coplanar parallel spaced-apart elongated anode members which are electrochemically active for the oxidation of oxygen. The anodes disclosed in WO00/40781 are fitted with a series of inclined baffles promoting the circulation of electrolyte through the anodes and are designed for use with a cathode surface that is horizontal or at a small angle as disclosed in WO01/31086 (de Nora/Duruz).

In WO00/40782 the electrochemically active anode surface may be substantially vertical, the horizontal anode members being spaced apart one above the other, for example like venetian blinds next to a substantially vertical cathode. In particular, two downwardly converging spaced apart adjacent anodes can be arranged between a pair of substantially vertical cathodes. The adjacent anodes are spaced apart by an electrolyte down-flow gap in which alumina-rich electrolyte flows downwards until it circulates via the adjacent anodes' flow-through openings into the inter-electrode gaps.

OBJECTS OF THE INVENTION

It is an object of the invention to provide an aluminium electrowinning cell having a drained aluminium-wettable sloping cathode surface, in particular at a steep slope, and one or more correspondingly sloping oxygen-evolving anodes, with an improved electrolyte circulation.

It is also an object of the invention to provide an aluminium electrowinning cell with a sloping drained-cathode and one or more anodes which have a large surface area and a high electrochemical activity for the oxidation of oxygen ions for the formation of bimolecular gaseous oxygen and which permit fast oxygen gas release, improved dissolution of alumina in the electrolyte and circulation of alumina-rich electrolyte between the anodes and a facing cathode.

A further object of the invention is to provide an aluminium electrowinning cell with a sloping drained-cathode and one or more metal-based non-carbon anodes whose design permits an enhanced electrolyte circulation and which are easy and economical to manufacture.

A major object of the invention is to provide an aluminium electrowinning cell which generates less pollution than conventional Hall-Héroult cells.

SUMMARY OF THE INVENTION

The invention relates to a cell for the electrowinning of aluminium from alumina. The cell comprises an inclined plate-like or grid-like open anode structure which has a generally v-shaped configuration in cross-section. The anode has a downwardly-oriented sloping electrochemically active surface that is generally v-shaped in cross-section and spaced above an upwardly-oriented corresponding sloping cathode surface by an anode-cathode gap in which alumina dissolved in a circulating electrolyte is electrolysed. The generally v-shaped plate-like or grid-like open anode structure has a plurality of anode through-passages distributed thereover for an up-flow of alumina-depleted electrolyte from the anode-cathode gap.

According to the invention, one or more electrolyte guide members located above the generally v-shaped plate-like or grid-like open anode structure is/are arranged to guide substantially all the up-flowing alumina-depleted electrolyte to an alumina feeding area where it is enriched with alumina and then over and around an upper end of the generally v-shaped plate-like or grid-like anode structure from where alumina-enriched electrolyte is fed into the anode-cathode gap.

The cell is usually so arranged that at least part of the alumina-enriched electrolyte is fed into an upper end of the anode-cathode gap and/or circulated outside and around the anode-cathode gap a towards a lower end thereof. At least part of the alumina-enriched electrolyte can be circulated outside the anode-cathode gap, for example along an inactive surface of the cathode, and fed into a lower end thereof. In some embodiments, electrolyte circulating behind the cathode surface can enter the anode-cathode gap through openings in the cathode.

The downwardly-oriented sloping electrochemically active surface is usually at an angle between 15 deg. and up to nearly vertical, typically 85 deg. Such an anode configuration advantageously has active anode surfaces with a steep slope, i.e. above 45 deg., typically from 60 deg. to 80 deg.

The electrolyte guide member(s) conveniently cover(s) substantially the entire generally v-shaped plate-like or grid-like open active anode structure to guide substantially all the alumina-depleted electrolyte flowing up from the active anode structure.

In one embodiment, the electrolyte guide member(s) has/have an opening for the passage of alumina-depleted electrolyte. Such electrolyte guide member(s) can have a downwardly-oriented guide surface arranged to confine the up-flowing alumina-depleted electrolyte into the opening, the guide surface being substantially horizontal or having a generally inverted v or u shape in cross-section with the opening at a top end of the generally inverted v or u shape.

In another embodiment, the cell comprises at least one passage for alumina-depleted electrolyte located between the electrolyte guide member(s) and the generally v-shaped plate-like or grid-like open anode structure. The electrolyte guide member(s) may have a downwardly oriented guide surface for confining the up-flowing alumina-depleted electrolyte into the passage(s) between the electrolyte guide member(s) and the generally v-shaped plate-like or grid-like open anode structure, the guide surface being substantially horizontal or at a slope that leads to the passage(s) for example by being generally v- or u-shaped in cross-section.

The generally v-shaped open anode structure may comprise a series of elongated anodes members, each having an elongated surface which is electrochemically active for the evolution of oxygen. The anode members are connected to one another, usually by at least one connecting member for example as disclosed in WO00/40782 (de Nora). The elongated anode members are generally parallel to one another and in a generally v arrangement in cross-section to form the electrochemically active surface having a generally v-shaped cross-section. The anode members are spaced apart from one another by inter-member gaps that form the through-passages.

The elongated anode members may be horizontal or at a slope parallel to the sloping cathode surface, in particular generally extending along a vertical plane that is perpendicular to the cathode surface. Preferably the elongated anode members have a cross-section that is proportional to the anodic current passed therethrough, i.e. a decreasing cross-section with a decreasing amount of current, to maintain a substantially uniform current density along the anode members. For example, the elongated anode members are elongated plates or blades, or rods, bars or wires.

The generally v-shaped open anode structure can be formed by a v-shaped foraminate plate or grid or by two downwardly converging foraminate plates or grids arranged like a v. Suitable grid-type active anode structures are disclosed in WO00/40782 (de Nora).

The anode's electrochemically active surface can be made up of two downwardly converging substantially flat faces or could be generally conical or pyramidal.

In one embodiment, the cell of the invention comprises a passage outside and around the anode-cathode gap for the return of at least part of the alumina-enriched electrolyte towards a bottom end of the anode-cathode gap. Advantageously, the return passage is behind the upwardly-oriented sloping cathode surface.

For instance, the upwardly-oriented sloping cathode surface is formed by a sloping cathodic plate having a downwardly-oriented sloping surface in the electrolyte. Usually, the cathodic plate has a bottom end in an aluminium collection pool and/or it is suspended in the electrolyte. A circulation of electrolyte can be provided behind the cathodic plates into the bottom end of the anode-cathode gap.

Alternatively, the upwardly-orientated sloping cathode surface can be formed by a series of spaced apart parallel elongated cathodic members, such as bars, rods or plates, in a grid-like arrangement. In this case, circulation of electrolyte can be provided downwardly behind the elongated cathodic members and into the anode-cathode gap through passages between the elongated cathodic members.

The cathodic plates or elongated cathodic members may be placed into existing or new Hall-Héroult cells or into cells of new design. The cell bottom is preferably aluminium-wettable. It can be made of carbon, in particular carbon blocks, optionally coated with an aluminium-wettable material, for example as disclosed in U.S. Pat. No. 5,651,874 (de Nora/Sekhar), WO98/17842 (Sekhar/Duruz/Liu), WO01/42531 (Nguyen/Duruz/de Nora), WO01/42168 (de Nora/Duruz) and PCT/IB02/01932 (Nguyen/de Nora).

Such a cathode design on the one hand provides a great aluminium storage capacity and a great active cathode surface area, and on the other hand reduces the required cathodic material for producing the sloping cathodes.

The cathodic plates or elongated cathodic members are preferably made of aluminium-wettable openly porous ceramic-based material that is chemically and mechanically resistant and filled with molten aluminium.

Suitable ceramic-based materials that are substantially resistant and inert to molten aluminium include oxides of aluminium, zirconium, tantalum, titanium, silicon, niobium, magnesium and calcium and mixtures thereof, as a simple oxide and/or in a mixed oxide, for example an aluminate of zinc (e.g. $ZnAlO_4$) or titanium (e.g. $TiAlO_5$). Other suitable inert and resistant ceramic materials can be selected amongst nitrides, carbides and borides and oxycompounds thereof, such as aluminium nitride, AlON, SiAlON, boron nitride, silicon nitride, silicon carbide, aluminium borides, alkali earth metal zirconates and aluminates, and their mixtures.

Preferably, the aluminium-wettable openly porous plates or elongated cathodic members contain an aluminium-wetting agent. Suitable wetting agents include metal oxides which are reactable with molten aluminium to form a surface layer containing alumina, aluminium and metal derived from the metal oxide and/or partly oxidised metal, such as manganese, iron, cobalt, nickel, copper, zinc, molybdenum, lanthanum or other rare earth metals or combinations thereof, e.g. as disclosed in PCT/IB02/00668 (de Nora).

Further suitable materials for producing the openly porous plates or elongated cathodic members are described in U.S. Pat. No. 4,600,481 (Sane/Wheeler/Gagescu/Debely/Adorian/Derivaz).

Furthermore, the cathode facing the generally v-shaped plate-like or grid-like open anode structure can have the features of the cathodes with the sloping drained cathode surfaces described in U.S. Pat. No. 5,651,874 (de Nora/Sekhar), U.S. Pat. No. 5,683,559 (de Nora), WO99/02764 (de Nora/Duruz), WO01/31088 (de Nora), WO98/53120 (Berclaz/de Nora), WO99/41429 (de Nora/Duruz), WO00/63463 (de Nora), WO01/31086 (de Nora/Duruz) and WO01/42531 (Nguyen/Duruz/de Nora).

The anodes are made of substantially non-consumable materials, usually oxygen evolving materials, in particular metal-based materials, such as surface oxidised alloys. The anodes can also be made of materials active for the oxidation of fluorine ions. Suitable metal-based anodes for the oxidation of oxygen ions or fluorine ions are disclosed in WO00/06802, WO00/06803 (both in the name of Duruz/de Nora/Crottaz), WO00/06804 (Crottaz/Duruz), WO01/43208 (Duruz/de Nora), WO01/42534 (de Nora/Duruz) and WO01/42536 (Duruz/Nguyen/de Nora). Further oxygen-evolving anode materials are disclosed in WO99/36593, WO99/36594, WO00/06801, WO00/06805, WO00/40783 (all in the name of de Nora/Duruz), WO00/06800 (Duruz/de Nora), WO99/36591 and WO99/36592 (both in the name of de Nora).

The oxygen-evolving anodes may be coated with a protective layer made of one or more cerium compounds, in particular cerium oxyfluoride, as disclosed in U.S. Pat. No. 4,614,569 (Duruz/Derivaz/Debely/Adorian), U.S. Pat. No.

4,680,094 (Duruz), U.S. Pat. No. 4,683,037 (Duruz), U.S. Pat. No. 4,966,674 (Bannochie/Sheriff), PCT/IB02/00667 (Nguyen/de Nora) and PCT/IB02/01169 (de Nora/Nguyen).

Advantageous methods of operating the cell are disclosed in WO00/06802 (Duruz/de Nora/Crottaz), WO01/42535 (Duruz/de Nora), WO01/42536 (Duruz/Nguyen/de Nora) and PCT IB01/00954 (Nguyen/de Nora).

The cell according to the invention can be an entirely new cell or a retrofitted cell that comprises a cell bottom of a refurbished cell retrofitted with the above described anode structure and sloping cathode.

Another aspect of the invention concerns a method of electrowinning aluminium from alumina in a cell as described above. The method comprises: electrolysing alumina dissolved in the electrolyte that circulates in the anode-cathode gap to produce aluminium cathodically and oxygen on the electrochemically active surface of the inclined open anode structure, the anodically-evolved oxygen promoting an up-flow of alumina-depleted electrolyte from the anode-cathode gap, through the anode through-passages and passed the electrolyte guide member(s) that guide(s) substantially all the up-flowing alumina-depleted electrolyte to the alumina feeding area; and feeding alumina to the alumina feeding area where it is dissolved in the electrolyte and from where the alumina-enriched electrolyte is guided over and around the upper end of the anode structure and fed into the anode-cathode gap.

The invention also relates to an anode for the electrowinning of aluminium from alumina dissolved in a molten electrolyte. The anode comprises an inclined plate-like or grid-like open anode structure having a generally v-shaped configuration in cross-section and an operative position in which it has a downwardly-oriented sloping electrochemically active surface that is generally v-shaped in cross-section. The generally v-shaped plate-like or grid-like open anode structure has a plurality of anode through-passages distributed thereover for an up-flow of alumina-depleted electrolyte from the electrochemically active surface through the generally v-shaped anode structure.

According to the invention, the anode further comprises one or more electrolyte guide members located above the generally v-shaped plate-like or grid-like open anode structure and arranged for guiding substantially all up-flowing alumina-depleted electrolyte to an alumina feeding area where it is enriched with alumina and then over and around an upper end of the generally v-shaped plate-like or grid-like anode structure from where the alumina-enriched electrolyte is circulated along the electrochemically active surface.

The anode of the invention may incorporate all the above described features relating to the electrochemically active anode structure and to the electrolyte guide member(s).

BRIEF DESCRIPTION OF THE DRAWINGS

The invention will now be described by way of examples with reference to the schematic drawings, wherein.

DETAILED DESCRIPTION

Figure 1A:
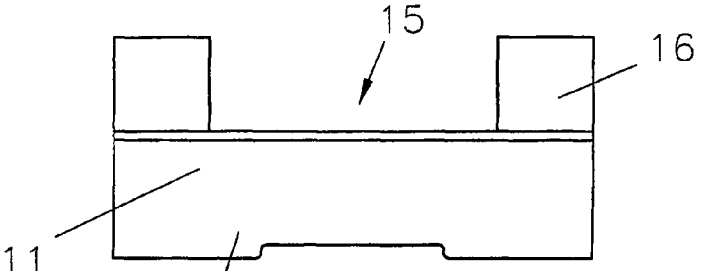
FIGS. 1*a* and 1*b* show a plan view and a front elevational view, respectively, of the cathode element shown in FIG. 1.
Figure 1B:
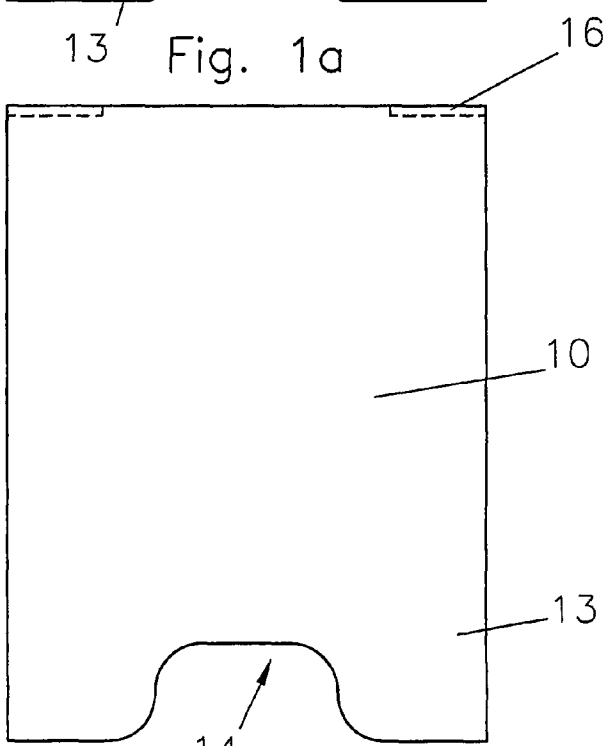
Figure 1:
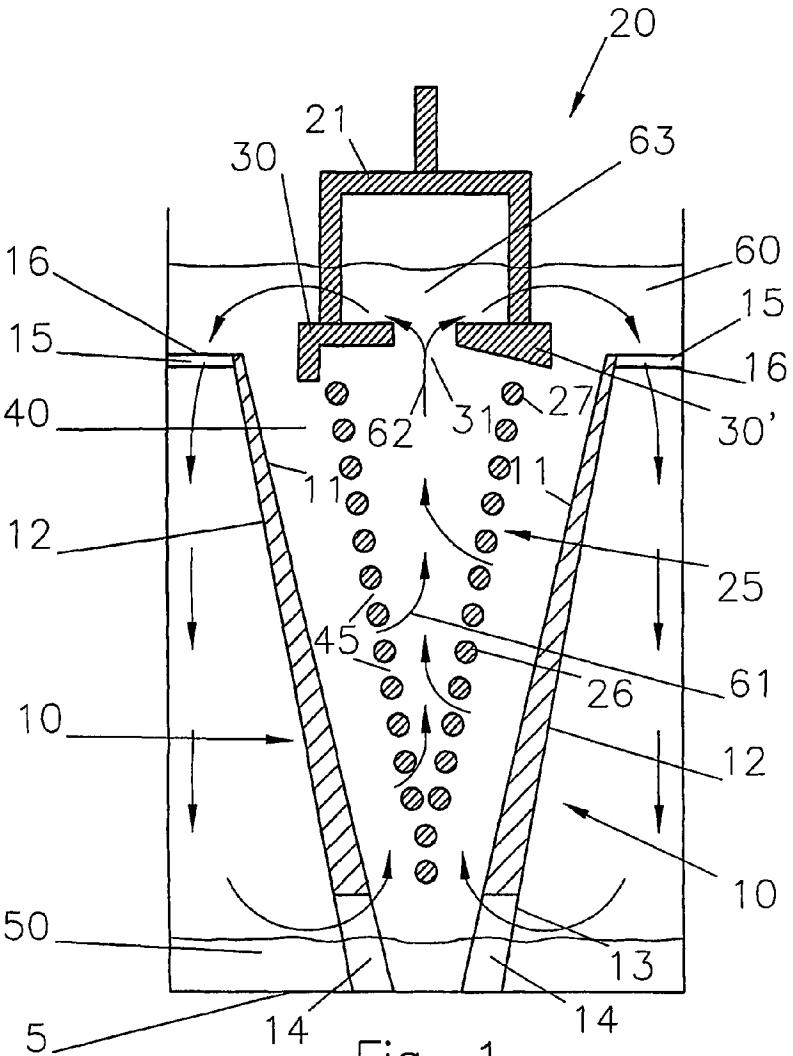
FIG. 1 shows a cross-sectional view of a drained-cathode cell according to the invention with a foraminate generally v-shaped oxygen-evolving anode.

FIG. 1 shows an aluminium production cell according to the invention having a horizontal cell bottom 5 covered with a pool of product aluminium 50. The cell has two inclined cathodic plates 10 in a molten electrolyte 60. Each plate 10 has an upwardly-orientated sloping aluminium-wettable drained cathode surface 11 separated by an anode-cathode gap 40 from a corresponding sloping active anode surface of an anode 20 having a v-shaped grid-like foraminate active structure 25 covered by an electrolyte guide member in accordance with the invention, shown with two possible shapes for the guide member 30,30' as discussed below.

The cathodic plates 10 also have a downwardly-orientated inclined rear face 12 in the electrolyte 60. This rear face 12 overlies the aluminium pool 50 that covers substantially the entire cell bottom 5. A bottom end 13 of the cathodic plates 10 rests on the cell bottom 5 in the aluminium pool 50 through which electrical current is passed from an external current supply to the cathodic plates 10. The section of cathodic plates 10 decreases with an increasing distance to the cathodic pool 50 so as to compensate for the current passed from the drained cathode surfaces 11 to the anodes 20 and provide a substantially uniform current density in plates 10 along substantially the entire height of plates 10.

As shown in FIGS. 1*a* and 1*b*, the cathodic plate 10 has a cut-out 14 in its bottom end 13 for passage of the aluminium pool 50 and for providing a return flow of alumina-enriched electrolyte 60 to the bottom end of the anode-cathode gap 40.

Furthermore, the cathodic plate 10 has at its upper edge a pair of horizontally extending flanges 16 that space the active part of plate 10 from the sidewall of the cell. A passage 15 is provided between flanges 16 for the down-flow of alumina-enriched electrolyte 60 from above the upper end 27 of active anode structure 25 and then behind the drained cathode surface 11 to the lower end of the anode-cathode gap 40.

Instead of using plates with flanges that delimit an electrolyte passage, a substantially uniformly planar cathodic plate may be provided with an opening in its upper part or, alternatively, a substantially uniformly planar cathodic plate may be placed against one or more spaced apart protrusions extending from the cell sidewall or against a recess in the sidewall at the level of the upper part of the cathodic plates.

The cathodic plate 10 is made of aluminium-wettable openly porous material that is mechanically and chemically resistant and filled with molten aluminium, as described above.

The anode 20 is suspended in the electrolyte 60 by a yoke 21 with the downwardly-orientated active anode surface formed by the v-shaped grid-like foraminate structure 25 substantially parallel to the upwardly-oriented cathode surfaces 11. The v-shaped grid-like foraminate structure 25 is made of a series of parallel horizontal rods 26 (shown in cross-section) forming a downwardly-oriented generally v-shaped electrochemically active open anode surface. The anode rods 26 are electrically and mechanically connected through one or more cross-members (not shown), as disclosed in WO00/40782 (de Nora), and spaced apart from one another by inter-member gaps 45 that form passages for an up-flow 61 of alumina-depleted electrolyte 60. Alternatively, the v-shaped foraminate anode structure can be made of inclined rods in a v configuration (see FIG. 2) or a v-shaped perforated plate, such as an expanded metal mesh or a pair of downwardly converging perforated plates.

According to the invention, the anode 20 comprises an electrolyte guide member 30,30' above the v-shaped grid-like anode structure 25 to guide all the up-flowing alumina-depleted electrolyte 62 through a central opening 31 in the guide member 30,30' to an alumina feeding area 63 where it is enriched with alumina, and then sideways over and around an upper end 27 of the anode structure 25 so that the alumina-enriched electrolyte 60 is mainly circulated through passage 15 at the top end of plate 10 and from there along the downwardly-orientated sloping surface 12 of plate 10 and then through the cut-out 14 in the bottom end 13 of plate 10 into a lower end of the anode-cathode gap 40. In this embodiment, a smaller part of the alumina-enriched electrolyte 60 is fed over the upper end 27 of the anode structure 25 into an upper end of the anode-cathode gap 40.

The geometry of the cell, in particular the section of the upper end of the anode-cathode gap 40 and of the passage 15, sets the ratio between the electrolyte 60 fed into the upper end of the anode-cathode gap 40 and the electrolyte 60 circulated through passage 15 to the lower end of the anode-cathode gap 40.

In the left-hand side of FIG. 1, the guide member 30 is shown in the shape of a horizontal plate with a downwardly extending peripheral flange. In the right-hand side of FIG. 1 shows a guide member 30' with a sloping downwardly-orientated surface leading into the central opening 31. Other shapes are of course possible.

In a variation, the electrolyte guide member is dissociated from the anode.

During operation, alumina is electrolysed in the anode-cathode gap 40 and oxygen formed on the v-shaped grid-like foraminate structure 25 of the anode 20. The oxygen escapes upwardly through the gaps 45 promoting an up-flow 61 of alumina-depleted electrolyte 60. The electrolyte up-flow is confined as indicated by arrow 62 by the electrolyte guide member 30,30' into the opening 31 and guided to the area 63 located thereabove where alumina is fed and enriches the circulating electrolyte 60. The alumina-enriched electrolyte 60 is then guided sideways and passes mainly behind the cathodic plate 10 into the lower end of the anode-cathode gap 40 with the remainder into the upper end of gap 40, as described above.

Figure 2:
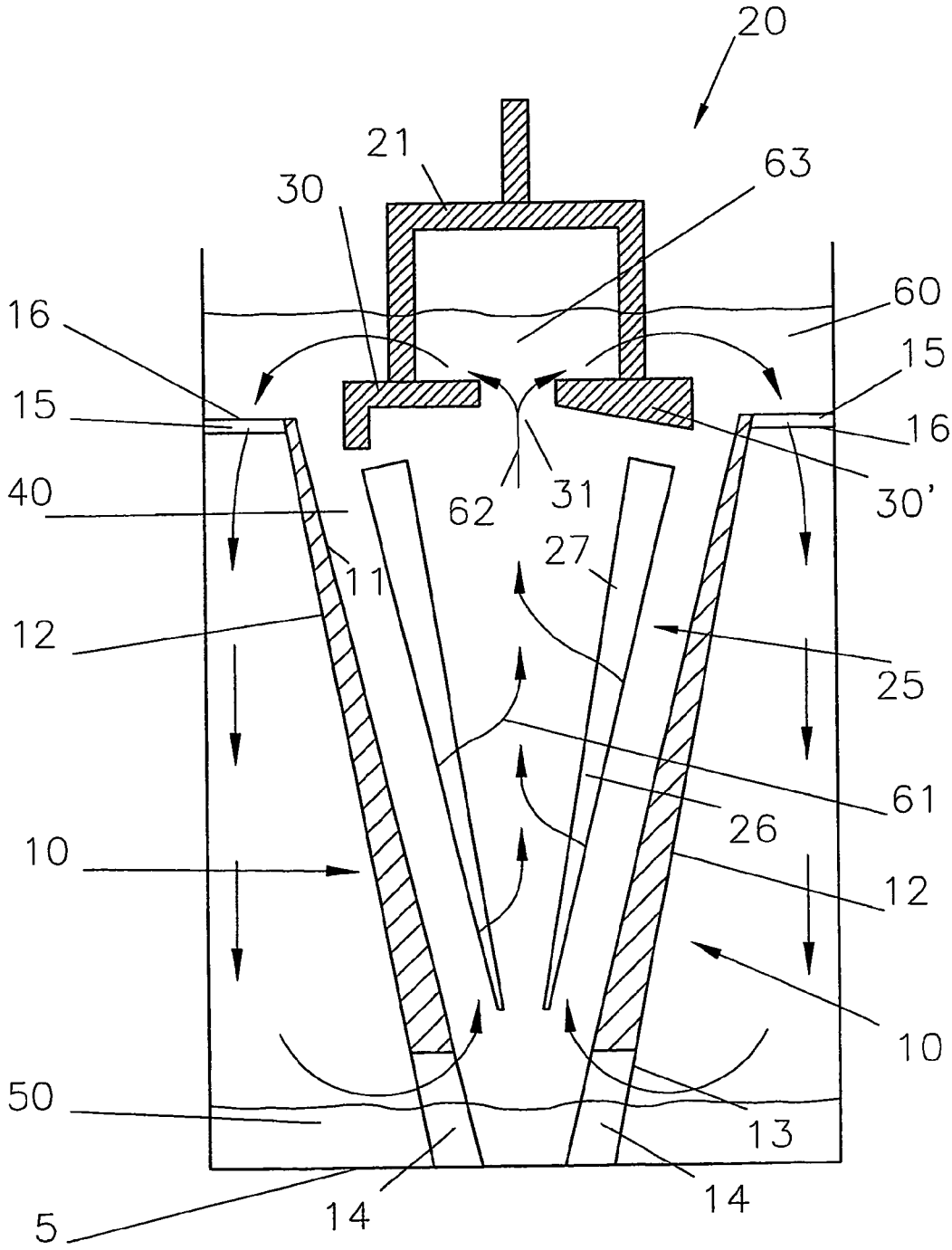
FIG. 2 shows a cross-sectional view of a drained-cathode cell according to the invention with another foraminate generally v-shaped oxygen-evolving anode.

FIG. 2, where the same reference numerals designate the same elements, shows another cell according to the invention in which the generally v-shaped grid-like anode structure 25 is made of a series of parallel spaced-apart inclined rods 26, each rod extending along a vertical plane that is perpendicular to the aluminium-wettable drained cathode surface 11.

The spacing between inclined rods 26 forms a passage for the up-flow 61 of alumina-depleted electrolyte 61 sideways around rods 26.

To provide a uniform current distribution, each inclined rod 26 has a variable cross-section (the rods 26 being downwardly tapered) so as to compensate for the current passed to the drained cathode surface 11.

In a variation, the inclined anode rods 26 are substituted with other elongated anode members, for example bars, blades or plates.

Figure 3:
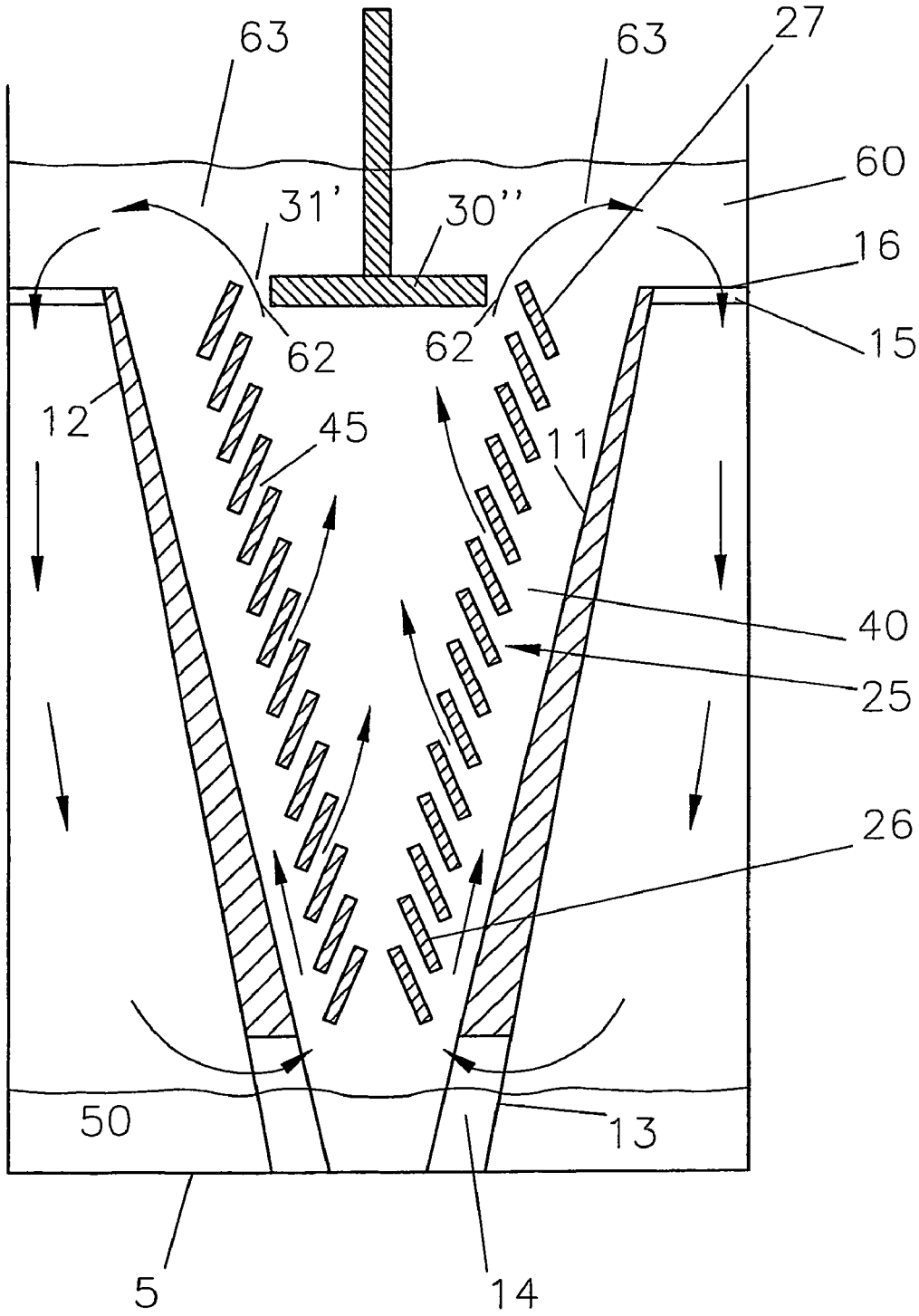
FIG. 3 shows a cross-sectional view of a drained-cathode cell according to the invention with yet another foraminate generally v-shaped oxygen-evolving anode.

FIG. 3, where the same reference numerals designate the same elements, shows another cell according to the invention in which the generally v-shaped grid-like anode structure 25 is made of a series of parallel spaced-apart horizontal blades 26 arranged like venetian blinds.

Furthermore, the anode structure 25 is covered with an electrolyte guide member 30" in the shape of a plate placed in-between the upper ends 27 of the anode structure 25 leaving passages 31' between upper ends 27 and the guide member 30" for alumina-depleted electrolyte 60 in accordance with the invention. In a variation, this guide member has a downwardly-oriented guide surface that has a general flattened u- or v-shape in cross-section leading to passages 31'.

Figure 4:
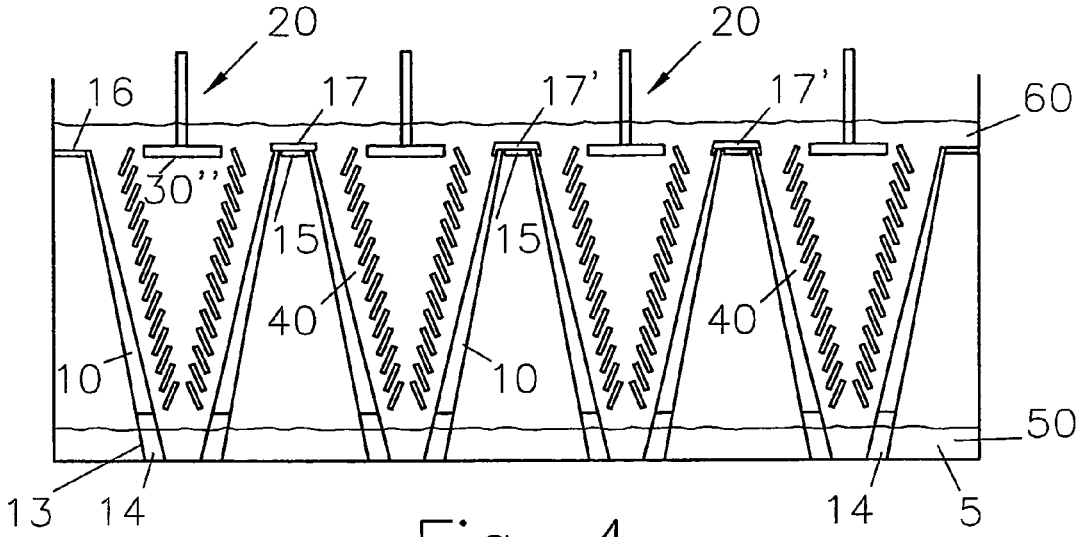
FIG. 4 shows a cross-sectional view of a drained-cathode cells according to the invention fitted with several anodes, enlarged views of different possibilities being shown in FIGS. 4*a* and 4*b*.

FIG. 4, where the same reference numerals designate the same elements as before, shows a cell with a series of side-by-side pairs of cathodic plates 10 in a v-shaped arrangement in cross-section and several anodes 20 of the type disclosed in FIG. 3 covered with electrolyte guide members 30" in accordance with the invention. In a variation, the anodes 20 can be substituted with the anodes shown in FIG. 1.

Neighbouring upper edges of plates 10 are spaced apart by spacer members 17,17' leaving between them a passage 15 for the circulation of alumina-enriched electrolyte 60 to a bottom end of the anode-cathode gap 40.

Figure 4A:
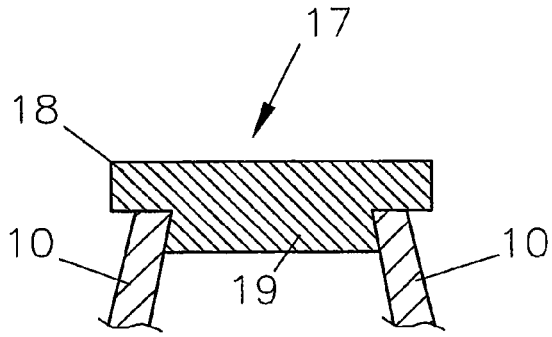

The spacer member 17 shown on the left-hand side of FIG. 4 and in FIG. 4*a* has horizontally extending upper flanges 18 on the upper edges of plates 10 and a central part 19 that holds the upper edges of plates 10 apart.

Figure 4B:
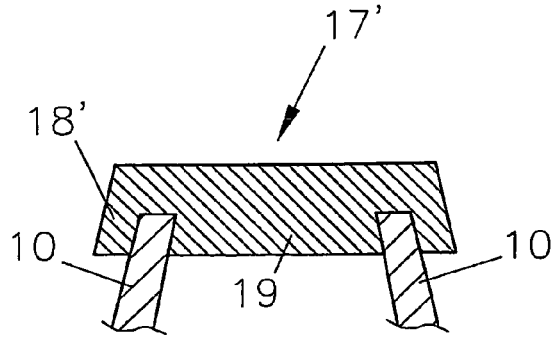

The spacer member 17' shown on the right-hand side of FIG. 4 and in FIG. 4*b* has flanges 18' that surround and secure the upper edges of plates 10 against the central spacing part 19.

Like in FIGS. 1, 1*a*, 1*b*, 2 and 3, the bottom parts 13 of the cathodic plates 10 shown in FIG. 4 are provided with openings 14 for the passage of the aluminium pool 50 and the return flow of alumina-enriched electrolyte 60.

The entire cell configuration of FIG. 4 or the anodes 20 shown in FIGS. 1 to 3 with corresponding cathodes may be retrofitted into existing Hall-Héroult cells or may be used in cells of new design, in particular in cells operating at reduced temperatures, typically 850° to 940° C.

In commercial cells, for example as schematically shown in FIG. 4, the level of the aluminium pool 50 may be allowed to fluctuate on the cell bottom or the aluminium may be collected, e.g. over a weir that sets a maximum level of the aluminium pool, in a separate collection reservoir of the aluminium production cell.

In a variation, the cathodic plates 10 shown in FIGS. 1 to 4 may be substituted with a series of parallel elongated cathodic members as mentioned above or with solid wedge-shaped cathode bodies placed on a cell bottom, for instance as disclosed in WO01/31088 (de Nora), or the anodes 20 may face a cathodic cell bottom that has a sloping drained cathode surface, in particular v-shaped as disclosed in U.S. Pat. No. 5,683,559 (de Nora) and WO99/41429 (de Nora/Duruz).

The invention claimed is:

1. A cell for the electrowinning of aluminium from alumina, comprising an inclined plate-like or grid-like open anode structure which has a generally v-shaped configuration in cross-section and which has a downwardly-oriented sloping electrochemically active surface that is generally v-shaped in cross-section and spaced above an upwardly-oriented corresponding sloping cathode surface by an anode-cathode gap in which alumina dissolved in a circulating electrolyte is electrolysed, the generally v-shaped plate-like or grid-like open anode structure having a plurality of anode through-passages distributed thereover for an up-flow of alumina-depleted electrolyte from the anode-cathode gap, characterised in that one or more electrolyte guide members located above the generally v-shaped plate-like or grid-like open anode structure is/are arranged to guide substantially all the up-flowing alumina-depleted electrolyte to an alumina feeding area where it is enriched with alumina and then over and around an upper end of the generally v-shaped plate-like or grid-like anode structure from where alumina-enriched electrolyte is fed into the anode-cathode gap.

2. The cell of claim 1, which is so arranged that alumina-enriched electrolyte is circulated outside the anode-cathode gap and fed towards a lower end thereof.

3. The cell of claim 2, which is so arranged that alumina-enriched electrolyte circulated outside the anode-cathode gap is fed into a lower end thereof.

4. The cell of claim 1, which is so arranged that alumina-enriched electrolyte is fed into an upper end of the anode-cathode gap.

5. The cell of claim 1, wherein the electrolyte guide member(s) cover(s) substantially the entire generally v-shaped plate-like or grid-like open anode structure.

6. The cell of claim 1, wherein the electrolyte guide member(s) has/have an opening for the up-flow of alumina-depleted electrolyte.

7. The cell of claim 6, wherein the electrolyte guide member(s) has/have a downwardly-oriented guide surface arranged to confine up-flowing alumina-depleted electrolyte into said opening, the guide surface being substantially horizontal or having a generally inverted v or u shape in cross-section with said opening at a top end of the generally inverted v or u shape.

8. The cell of claim 1, comprising at least one passage for alumina-depleted electrolyte located between the electrolyte guide member(s) and the generally v-shaped plate-like or grid-like open anode structure.

9. The cell of claim 8, wherein the electrolyte guide member(s) has/have a downwardly oriented guide surface for confining up-flowing alumina-depleted electrolyte into said at least one passage between the electrolyte guide member(s) and the generally v-shaped plate-like or grid-like open anode structure, the guide surface being substantially horizontal or having a generally v or u shape in cross-section.

10. The cell of claim 1, wherein the generally v-shaped open anode structure comprises a series of elongated anodes members in a grid-like arrangement, each having an elongated surface which is electrochemically active for the evolution of oxygen, the elongated anode members being generally parallel to one another and making up a generally v arrangement in cross-section to form said electrochemically active surface having a generally v-shaped cross-section, the anode members being spaced apart from one another by inter-member gaps that form said through-passages.

11. The cell of claim 10, wherein the elongated anode members are horizontal.

12. The cell of claim 10, wherein the elongated anode members are at a slope and parallel to the cathode surface.

13. The cell of claim 10, wherein the elongated anode members are elongated plates, blades rods, bars or wires.

14. The cell of claim 10, wherein the elongated anode members have a variable cross-section along their length.

15. The cell of claim 1, wherein the generally v-shaped open anode structure is formed by a v-shaped foraminate plate or by two downwardly converging foraminate plates arranged like a v.

16. The cell of claim 1, wherein the electrochemically active surface that is generally v-shaped in cross-section is generally conical or pyramidal.

17. The cell of claim 1, wherein the electrochemically active surface that is generally v-shaped in cross-section is made up of two downwardly converging substantially planar faces.

18. The cell of claim 1, which comprises a passage outside the anode-cathode gap for the return of part of the alumina-enriched electrolyte towards a bottom end of the anode-cathode gap.

19. The cell of claim 18, wherein the return passage is behind the upwardly-oriented sloping cathode surface.

20. The cell of claim 1, wherein the upwardly-oriented sloping cathode surface is formed by a sloping cathodic plate or a series of spaced apart parallel elongated cathodic members in a grid-like arrangement having a downwardly-oriented sloping surface in the electrolyte.

21. The cell of claim 20, wherein the cathodic plate or series of elongated cathodic members has a bottom end in an aluminium collection pool.

22. The cell of claim 20, wherein the cathodic plate or series of elongated cathodic members is suspended in the electrolyte.

23. The cell of claim 20, wherein the cathodic plate or series of elongated cathodic members is made of aluminium-wettable ceramic-based openly porous material filled with molten aluminium.

24. The cell claim 1, which comprises a cell bottom of a refurbished cell retrofitted with said anode structure and sloping cathode.

25. A method of electrowinning aluminium from alumina in a cell as defined in claim 1, comprising:

electrolysing alumina dissolved in the electrolyte that circulates in the anode-cathode gap to produce aluminium cathodically and oxygen on the electrochemically active surface of the inclined open anode structure, the anodically-evolved oxygen promoting an up-flow of alumina-depleted electrolyte from the anode-cathode gap, through the anode through-passages and passed the electrolyte guide member(s) that guide(s) substantially all the up-flowing alumina-depleted electrolyte to the alumina feeding area; and feeding alumina to the alumina feeding area where it is dissolved in the electrolyte and from where the alumina-enriched electrolyte is guided over and around the upper end of the anode structure and fed into the anode-cathode gap.

26. An anode for the electrowinning of aluminium from alumina dissolved in a molten electrolyte, comprising an inclined plate-like or grid-like open anode structure of generally v-shaped configuration in cross-section and having an operative position in which it has a downwardly-oriented sloping electrochemically active surface that is generally v-shaped in cross-section, the generally v-shaped plate-like or grid-like open anode structure having a plurality of anode through-passages distributed thereover for up-flow of alumina-depleted electrolyte from the electrochemically active surface through the generally v-shaped anode structure, characterised in that the anode further comprises one or more electrolyte guide members located, when the anode is in its operative position, above the generally v-shaped plate-like or grid-like open anode structure which guide member(s) is/are arranged for guiding substantially all up-flowing alumina-depleted electrolyte to an alumina feeding area where it is enriched with alumina and then over and around an upper end of the generally v-shaped plate-like or grid-like anode structure from where the alumina-enriched electrolyte is circulated along the electrochemically active surface.

* * * * *